US008851001B2

(12) United States Patent
Albano et al.

(10) Patent No.: US 8,851,001 B2
(45) Date of Patent: Oct. 7, 2014

(54) METHOD FOR IMPROVED STITCH GENERATION

(75) Inventors: Paul Albano, Westminster, CO (US); Scott David Stengel, Golden, CO (US)

(73) Assignee: Melco International LLC, Westminster, CO (US)

( * ) Notice: Subject to any disclaimer, the term of this patent is extended or adjusted under 35 U.S.C. 154(b) by 1346 days.

(21) Appl. No.: 12/355,674

(22) Filed: Jan. 16, 2009

(65) Prior Publication Data

US 2010/0180809 A1 Jul. 22, 2010

(51) Int. Cl.
*D05B 3/12* (2006.01)
*D05C 5/06* (2006.01)

(52) U.S. Cl.
CPC ..... *D05C 5/06* (2013.01)
USPC ..... 112/475.19; 112/470.01

(58) Field of Classification Search
CPC ..... D05C 5/00; D05C 5/02; D05C 5/04; D05C 5/06; D05B 19/02; D05B 19/08; D05B 19/10
USPC ..... 700/136–138; 112/470.01, 470.04, 112/470.06, 475.18, 475.19
See application file for complete search history.

(56) References Cited

U.S. PATENT DOCUMENTS

| | | | | |
|---|---|---|---|---|
| 4,945,842 | A * | 8/1990 | Nomoto et al. | 112/470.04 |
| 5,343,401 | A * | 8/1994 | Goldberg et al. | 112/475.19 |
| 5,558,031 | A * | 9/1996 | Muto et al. | 112/470.04 |
| 5,740,056 | A * | 4/1998 | Futamura | 112/475.19 |
| 7,016,756 | B2 * | 3/2006 | Goldman | 700/138 |

* cited by examiner

*Primary Examiner* — Nathan Durham
(74) *Attorney, Agent, or Firm* — The Ollila Law Group LLC

(57) ABSTRACT

A method for creating an altered embroidery design, the method comprising altering an embroidery design to create an altered embroidery design, the altered embroidery design comprising an at least one design element, determining a size of the at least one design element, selecting a stitch type for the at least one design element by comparing the size of the at least one design element to a set of values, wherein the stitch type can be selected from the set of values based on the size of the at least one design element, and generating a stitch pattern for the at least one design element.

25 Claims, 16 Drawing Sheets

| Size Range (Points) | Vector Conversion Fabric Style | | Lightweight Knit Fabric Style | | Heavyweight Knit Fabric Style | |
|---|---|---|---|---|---|---|
| | Size-Range-Stitch Type | | Size-Range-Stitch Type | | Size-Range-Stitch Type | |
| | Top-Stitch Type | Property (Density) | Top-Stitch Type | Density | Top-Stitch Type | Density |
| 0-10 | Satin | 4.7 | Satin | 4.5 | Satin | 4.2 |
| 11-20 | Satin | 4.0 | Satin | 4.0 | Satin | 3.8 |
| 21-30 | Satin | 3.8 | Satin | 3.7 | Satin | 3.6 |
| 31-40 | Satin | 3.7 | Satin | 3.6 | Satin | 3.5 |
| 41-45 | Satin | 3.6 | Satin | 3.5 | Satin | 3.4 |
| 46-50 | Satin | 3.6 | Satin | 3.5 | Fill | 3.6 |
| 51-60 | Satin | 3.5 | Fill | 3.8 | Fill | 3.6 |
| 61-70 | Fill | 3.8 | Fill | 3.8 | Fill | 3.6 |
| 71-80 | Fill | 3.8 | Fill | 3.8 | Fill | 3.6 |
| 81-90 | Fill | 3.8 | Fill | 3.8 | Fill | 3.6 |
| 91+ | Fill | 3.8 | Fill | 3.8 | Fill | 3.6 |

FIG. 3(a)

| Size Range (Points) | Vector Conversion Fabric Style | | Lightweight Knit Fabric Style | | Heavyweight Knit Fabric Style | |
|---|---|---|---|---|---|---|
| | Size-Range-Stitch Type | | Size-Range-Stitch Type | | Size-Range-Stitch Type | |
| | Underlay-Stitch Type | Properties | Underlay-Stitch Type | Properties | Underlay-Stitch Type | Properties |
| 0-20 | Primary<br>Center Walk | Stitch Length: 20 pt. | Primary<br>Edge Walk | Border Margin: 10 pt.<br>Stitch Length: 20 pt. | Primary<br>ZigZag | Width: 60 %<br>Density: 20 pt. |
| | Secondary<br>None | — | Secondary<br>None | — | Secondary<br>None | — |
| 21-50 | Primary<br>Edge Walk | Border Margin: 10 pt.<br>Stitch Length: 20 pt. | Primary<br>ZigZag | Width: 60 %<br>Density: 20 pt. | Primary<br>ZigZag | Width: 60 %<br>Density: 20 pt. |
| | Secondary<br>None | — | Secondary<br>None | — | Secondary<br>Edge Walk | Border Margin: 10 pt.<br>Stitch Length: 20 pt. |
| 51-90 | Primary<br>ZigZag | Width: 60 %<br>Density: 20 pt. | Primary<br>Double ZigZag | Width: 60 %<br>Density: 20 pt. | Primary<br>Double ZigZag | Width: 60 %<br>Density: 20 pt. |
| | Secondary<br>Edge Walk | Border Margin: 10 pt.<br>Stitch Length: 20 pt. | Secondary<br>None | — | Secondary<br>Edge Walk | Border Margin: 10 pt.<br>Stitch Length: 20 pt. |
| 90+ | Primary<br>Fill | Border Margin: 10 pt.<br>Density: 20 pt.<br>Angle: 90 degrees<br>Stitch Length: 20 pt. | Primary<br>Fill | Border Margin: 10 pt.<br>Density: 20 pt.<br>Angle: 90 degrees<br>Stitch Length: 20 pt. | Primary<br>Fill | Border Margin: 10 pt.<br>Density: 20 pt.<br>Angle: 90 degrees<br>Stitch Length: 20 pt. |
| | Secondary<br>Edge Walk | Border Margin: 10 pt.<br>Stitch Length: 20 pt. | Secondary<br>Edge Walk | Border Margin: 10 pt.<br>Stitch Length: 20 pt. | Secondary<br>Edge Walk | Border Margin: 10 pt.<br>Stitch Length: 20 pt. |

FIG. 3(b)

METHOD FOR IMPROVED STITCH GENERATION

FIELD OF THE INVENTION

The present invention relates generally to design software. More specifically, but not by way of limitation, the present invention relates to methods and apparatuses for designing and manipulating sewing patterns.

BACKGROUND OF THE INVENTION

Design programs allow the digital creation and manipulation of designs for a large number of applications. Embroidery designs are created using software design programs such as embroidery digitizing software. Such programs allow for the customization and selection of various design parameters and features.

Design programs are implemented on a computer system that allows users to create an embroidery design using design software and then export that design to an automated embroidery machine which can sew the design onto fabric.

After the designs are created using the design software, it is often necessary to alter the design for use on a different product which requires alteration in the size of the design or the type of fabric. When such changes occur, the user is required to re-calculate and re-enter parameter or feature selections which they made during the initial design. This process requires user expertise, takes a significant amount of time, and degrades the quality of the user experience.

Thus it is apparent that there is a need for design software which can automatically alter parameters and features when a design is altered.

When implemented, embroidery designs currently use a type of stitching called underlay. Underlay stitching is located behind the top-stitching and not visible when viewing the completed design itself. The function of the underlay is to provide a stable base for the top-stitching of the embroidery design. Currently, design programs associate an underlay stitch with each separate design element. When a group of design elements are located close together, the underlay for each design element is performed separately, which is less stable than if the underlay is performed continuously for the group of design elements.

Thus it is apparent that there is a need for design software which can automatically identify a group of design elements and perform a continuous underlay stitch for the group of design elements.

All embroidery satin and fill top-stitch shapes distort when they are sewn on fabric. This is due to the thread being stretched in length during the sewing process in order to keep it tight to the top of the fabric and properly set the lock stitch knot for each stitch. A given shape will shrink on the sides perpendicular to the stitch direction, and expand in the direction parallel to the stitch direction. An example of this would be if the user digitized a shape that was exactly 1" square with the stitch direction running horizontal, sewed it on fabric, and measured the actual embroidery shape sewn it would measure about 1.1" in height and 0.95" in width. Currently embroidery digitizing software programs only allow digitizers to account for the loss of width and no provision can be made by subtracting for the increase in height. The width compensation feature in embroidery digitizing programs is commonly referred to as 'Pull' compensation in the industry while height compensation is referred to as 'Push' compensation and does not exist in current programs. It has to be done manually by distorting the digitized shape in the embroidery file. This is done by shortening (cutting off) some of the top and bottom of the shape manually on screen.

Lettering accounts for a significant portion of all embroidery. The human eye looks at lettering on a straight base line and notices any deviations in the heights of the letters. Pleasing to the eye letters are very consistent in height. Embroidery programs contain digitized alphabet fonts. These are similar to True Type fonts in regular computer programs, but the letters are filled with stitches instead of just with a certain color. When digitizers create these embroidery alphabet fonts they must make each letter a certain height, and all letters are digitized at that same height. This produces reasonably consistent, pleasing looking lettering at the digitized height, but as the letters are scaled there is no provision for automatically adjusting for 'Push' compensation. Certain letters such as AFHIJKLMNPRTUVWXY and Z appear taller than those not listed.

Thus it is apparent that there is a need for design software which can automatically perform push compensation on design elements.

Currently, embroidery digitizing software only allows users to digitize their own tie-in and tie-off stitches manually each time tie stitches are needed, or select auto tie stitches from a limited amount of preset tie shapes that are built in to the software. Embroidery production facilities use different types of tie patterns based on the fabric the design will be sewn on and also the embroidery machine type the design will be produced on. If a user digitizes his own tie pattern it is only for the top stitch element following it, and when the design is scaled so are these stitches. This makes them too close together or too far apart to be effective.

Thus it is apparent that there is a need for design software which allows users to digitize and store custom tie stitches and recognize those tie stitches to prevent scaling.

SUMMARY OF THE INVENTION

Illustrative embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents, and alternative constructions that fall within the spirit and scope of the invention as expressed in the claims.

The present invention can provide a method and system for embroidery design. One illustrative embodiment is a method for creating an altered embroidery design, the method comprising altering an embroidery design to create an altered embroidery design, the altered embroidery design comprising an at least one design element, determining a size of the at least one design element, selecting a stitch type for the at least one design element by comparing the size of the at least one design element to a set of values, wherein the stitch type can be selected from the set of values based on the size of the at least one design element, and generating a stitch pattern for the at least one design element. In some embodiments, altering the embroidery design comprises scaling the design up or down in size, changing the fabric, changing the fabric orientation, and/or changing the backing. In other embodiments, selecting the stitch type can include selecting an underlay-stitch type or a top-stitch type. In yet another embodiment, the method can include assigning a temporary stitch type to the at least one design element, generating temporary stitches for the at least one design element, and determining the size of the at least one design element based on a stitch-width of the temporary stitches.

The present invention can also include a method for user-defined lock stitches comprising allowing a user to create a user-defined stitch pattern, wherein the user-defined stitch pattern comprises a defined size and storing the user-defined stitch pattern as a custom stitch pattern, wherein the custom stitch pattern can be inserted into a design at the defined size. In some embodiments, this method can further include designating the custom stitch pattern as a lock stitch, wherein the lock stitch is a stitch pattern that does not change in size during scaling.

Consistent with the present invention is a method of generating continuous underlay for a group of design elements in an embroidery design, the method comprising identifying a group of design elements, creating a graph of the group of design elements, determining an order for sewing a continuous underlay of the group of design elements using the graph, and generating a stitch pattern for the group of design elements, wherein the stitch pattern is based at least in part on the order for sewing the continuous underlay for the group of design elements. In one embodiment, the order for sewing the continuous underlay for the group of design elements is determined by identifying each edge in the graph, duplicating each edge in the graph to create a duplicate-line graph, executing a graph traversal algorithm on the duplicate-line graph, such as a Euler tour, breadth first search, and depth limited search, and generating a continuous underlay-stitch pattern based on the graph traversal algorithm.

In yet another illustrative method, a method for push compensation of a design element is disclosed where the method comprises determining a width of a first end of a design element, determining a push compensation for the first end of the design element by comparing the width of the first end of the design element to a list of push compensation values for certain width ranges, and performing the push compensation on the first end of the design element. In some embodiments, the method can further comprise selecting the list of predetermined values for certain width ranges based on a density of the first end of the design element, fabric type, thread type, thread tension, and/or backing.

These and other embodiments are described in further detail herein.

BRIEF DESCRIPTION OF THE DRAWINGS

Various objects and advantages and a more complete understanding of the present invention are apparent and more readily appreciated by reference to the following Detailed Description and to the appended claims when taken in conjunction with the accompanying Drawing wherein:

FIGS. 3*a* and 3*b* are charts of a possible stitch types for various representative fabrics.

DETAILED DESCRIPTION

In various illustrative embodiments of the invention, an embroidery design is created in or input into design software. Broadly, embroidery design refers to a digital file which contains information about one or more of shapes (e.g., raster shapes or vector shapes), shape size, stitch types, stitch patterns, stitch coordinates, fabric type and thread type for an embroidery. An embroidery design can be comprised of a single design element, a group of design elements, or multiple groups of design elements that together create an image which can be sewn onto fabric. A design element is a discrete portion of an embroidery design which is usually a geometric shape. A group of design elements is a group of intersecting, or sufficiently proximate, design elements. In one embodiment, a group of design elements may be used to control stitch direction in an intended shape. In another embodiment, a group of design elements may be a plurality of design elements which are sufficiently close to be treated as a group for continuous stitching.

Figure 1:
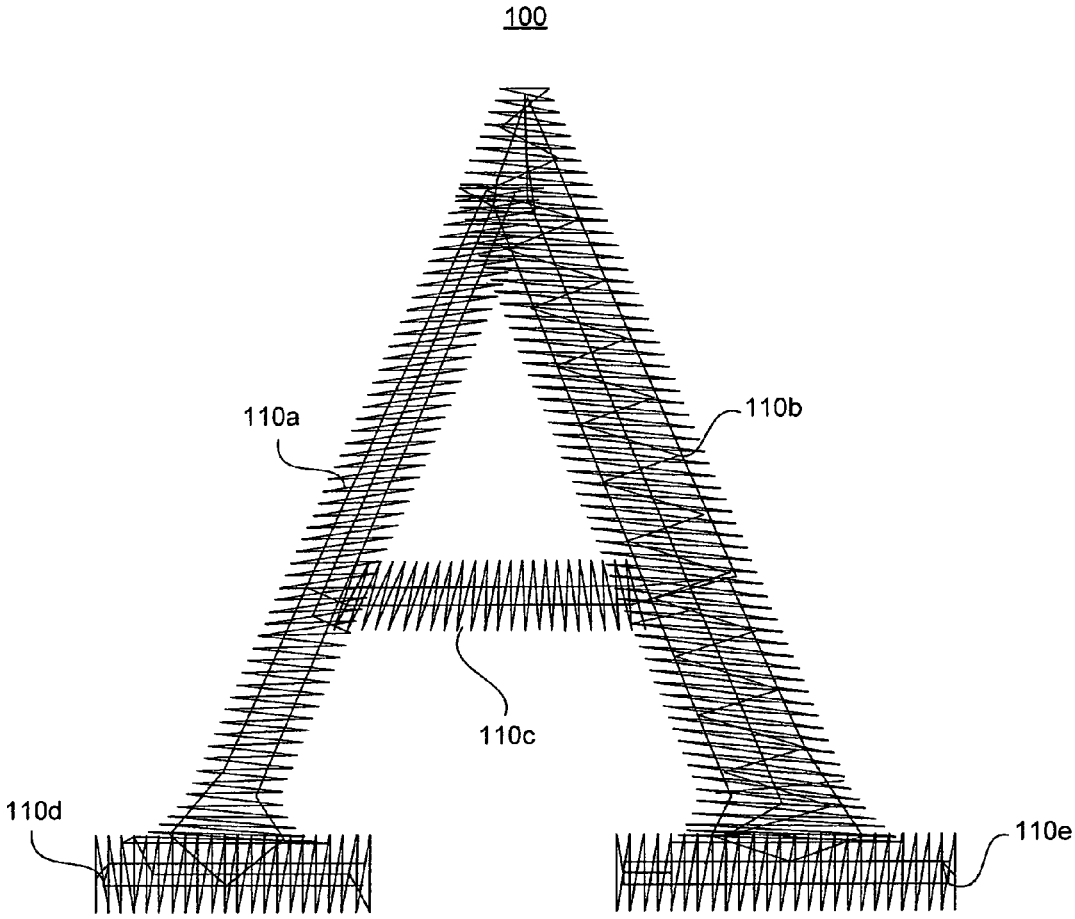
FIG. 1 is a sewing pattern for a letter "A" embroidery design which can be created and altered consistent with the present invention.

For example, referring to the drawings, where like or similar elements are designated with identical reference numerals throughout the several views, in FIG. 1 there is a sewing, or stitch, pattern for a letter "A" embroidery design 100 wherein the letter "A" embroidery design 100 is comprised of a group of design elements 110. The group of design elements 110 is further comprised of five (5) individual design elements 110*a*-110*e*. In FIG. 1, a group of intersecting design elements 110 is used to create an embroidery letter "A" 100. By using the group of design elements 110, the stitch direction and stitch width in each portion of the letter "A" can be controlled. For example, referring to design element 110*c*, it may be preferred that the stitch direction in design element 110*c* be substantially orthogonal to the stitch direction in design elements 110*a* and 110*b*. This prevents the top-stitch width of 110*c* from becoming too long and leading to snagging of the top-stitch thread. In addition, the different stitch directions can create a desired visual effect for the embroidery.

The use of the letter "A" embroidery design 100 is exemplary only and not intended to limit the present invention. In other embodiments, an embroidery design may be comprised of multiple letters and/or shapes. For example, in one embodiment two separate letter "A" embroidery designs 100 may be configured next to each other to form a single embroidery design. In such an embodiment, each letter "A" could be comprised of a separate group of at least one design element. The use of the five (5) design elements 110*a*-110*e* in FIG. 1 is also exemplary. Those skilled in the art will be readily aware of how various embroidery designs can be created from one or more groups of at least one design element.

Figure 2:
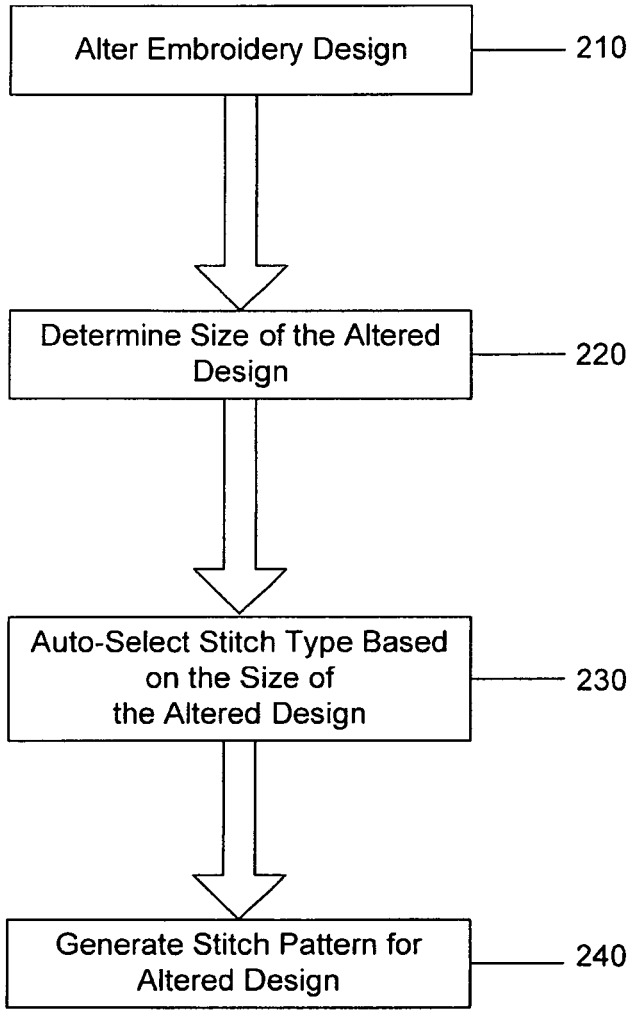
FIG. 2 is a flowchart of a method for selecting stitch types after measuring an altered design.

The present invention provides systems and methods for generating stitch patterns for a design element, a group or groups of design elements and embroidery designs. The flowchart of FIG. 2 shows one possible embodiment of a method for automated stitch selection consistent with the present invention. In FIG. 2 it shows a method for automatically selecting stitch type for an embroidery design. Stitch type refers to both underlay-stitch types and top-stitch types. Underlay-stitch types include center walk, edge walk, zigzag and fill. Top-stitch types include satin and step-fill. In some embodiments, a user could define their own underlay-stitch type or top-stitch type. In this embodiment, the user-defined stitch type would also be available for selection.

The method in FIG. 2 begins at 210 by altering an embroidery design. In one embodiment, altering an embroidery design 210 can include design software accepting user inputs for altering an embroidery design and the design software then changing the embroidery design itself based on the user inputs. In another embodiment, altering the embroidery design 210 can include only the steps taken by the design software to change the embroidery design. Altering the embroidery design 210 can take various forms. To illustrate without limitation, the embroidery design could be scaled larger or smaller, the type of fabric on which the design will be sewn could be changed, or the orientation of the design on the fabric could be changed. Other alterations will be known to a person of ordinary skill in the art.

In some embodiments, each design element can be stored as a vector shape. A vector shape is a mathematical definition of a geometric shape which is independent of size. Vector shapes allow for improved scalability during design alterations. For this reason, scaling of the embroidery design typically occurs by scaling the vector shapes. In another embodiment, each design element can be stored as a raster graphic or raster shape. For this embodiment, scaling of the design would typically occur by scaling the raster shape. However, due the format and limitations of raster shapes, some resolution and loss of apparent quality may occur during scaling.

Referring back to FIG. 2, after altering an embroidery design 210, the method will determine the size of the altered design 220 and then select the stitch type for the altered design 230 based on the size of the altered design. As used herein, the phrase "based on" is not intended to suggest exclusivity (i.e., based only on) but is instead used to represent "based at least in part on." In one embodiment, this process is performed on a design-element-by-design-element basis. That is, the method determines the size 220 of each design element and then selects the stitch type 230 for each design element based on each design element's size.

Determining the size of the altered design 220 can take various forms. In one embodiment, the size of the altered design 220 can be based on the average stitch width of the top-stitches of the altered design. In another embodiment, the size of the altered design 220 can be based on the median stitch width of the top-stitches of the altered design. If viewed on a design-element-by-design-element basis, the size of each design element can be based on the median top-stitch width of the individual design element. In another embodiment, the stitch width of the top-stitch at the 70th percentile of all top-stitch widths for the design element could be used as representative of the size of the design element. The reason for selecting a stitch width of the top-stitch at the 70th percentile of all top-stitch widths, is to error on the side of providing greater underlay support for the design element. Other top-stitch width percentiles could be selected consistent with the present invention.

In one embodiment in order to determine the median or 70th percentile top-stitch width for the design element, a temporary top-stitch type can be assigned to each design element. Once the temporary top-stitches are generated, the temporary top-stitches can be organized by stitch width. The top-stitch at the desired percentile can then be selected as representative of the size of the design element. Other methods of determining the median or 70th percentile top-stitch width will be understood by those of skill in the art.

Those of skill in the art will also be readily aware of other methods for determining the size of the altered design consistent with the present invention. For example, size could be determined based on properties of the vector shape(s) or raster shape(s) of the altered design. While a vector shape and raster shape are independent of size, in the altered design the vector shape and/or raster shape(s) can have a sizing property to identify the size to which the shape should be scaled. In one embodiment, a sizing property of the vector shape or raster shape, and the vector/raster shape itself, could be used in order to determine a size of the altered design. The disclosed embodiments are exemplary only and not intended to limit the present invention.

In one embodiment, selecting stitch type based on the size of the altered design 230 comprises comparing the size of the altered design to a set of values from which stitch type can be selected. The use of the phrase "set of values" is intended to include both numerical values, and stitch types corresponding to those numerical values. For example, in one embodiment, the set of values could be a set of size ranges and corresponding size-range-stitch types. This set of size ranges and corresponding size-range-stitch types could be organized in a list or a chart. Using such a set of size ranges and size-range-stitch types, the appropriate (not temporary) size-range-stitch type can be selected for the altered design. In the preferred embodiment, the stitch type is selected for each design element of the altered design on a design-element-by-design-element basis. This allows for selection of a more appropriate stitch type for each design element based on the individual design element's size. For example, using a list of size ranges and size-range-stitch types, the appropriate size-range-stitch type can be selected for each design element based on the size of each design element.

Referring now to FIGS. 3(*a*) and 3(*b*) there are exemplary stitch-type-selection charts that could be used as the set of values for selecting stitch type 230 consistent with the present invention. FIG. 3(*a*) shows a chart for selecting a size-range-stitch type for top-stitch type, where the size-range-stitch type includes both the top-stitch type and a property, here density, of the top-stitch type. The chart in FIG. 3(*a*) is split among vector conversion fabric style, lightweight knit fabric style and heavyweight knit fabric style. Those of skill in the art will be aware of many additional fabric styles that could be have a separate set of values. Similarly, for FIG. 3(*b*) there is a set of values for selecting stitch type based on size range for underlay-stitch type. In FIG. 3(*b*), the size-range-stitch type can include a primary and secondary-underlay-stitch type, or just a primary underlay stitch type, and specific properties for the underlay stitch type. Again, the size-range-stitch type for a given size range is shown to vary for different fabric types or fabric styles. These values can be preprogrammed so that users with little knowledge can still achieve superior embroidery designs. For advanced users, the ability to preset the values and have the system automatically adjust the stitch type as the design is altered can save a considerable amount of time.

Figure 4:
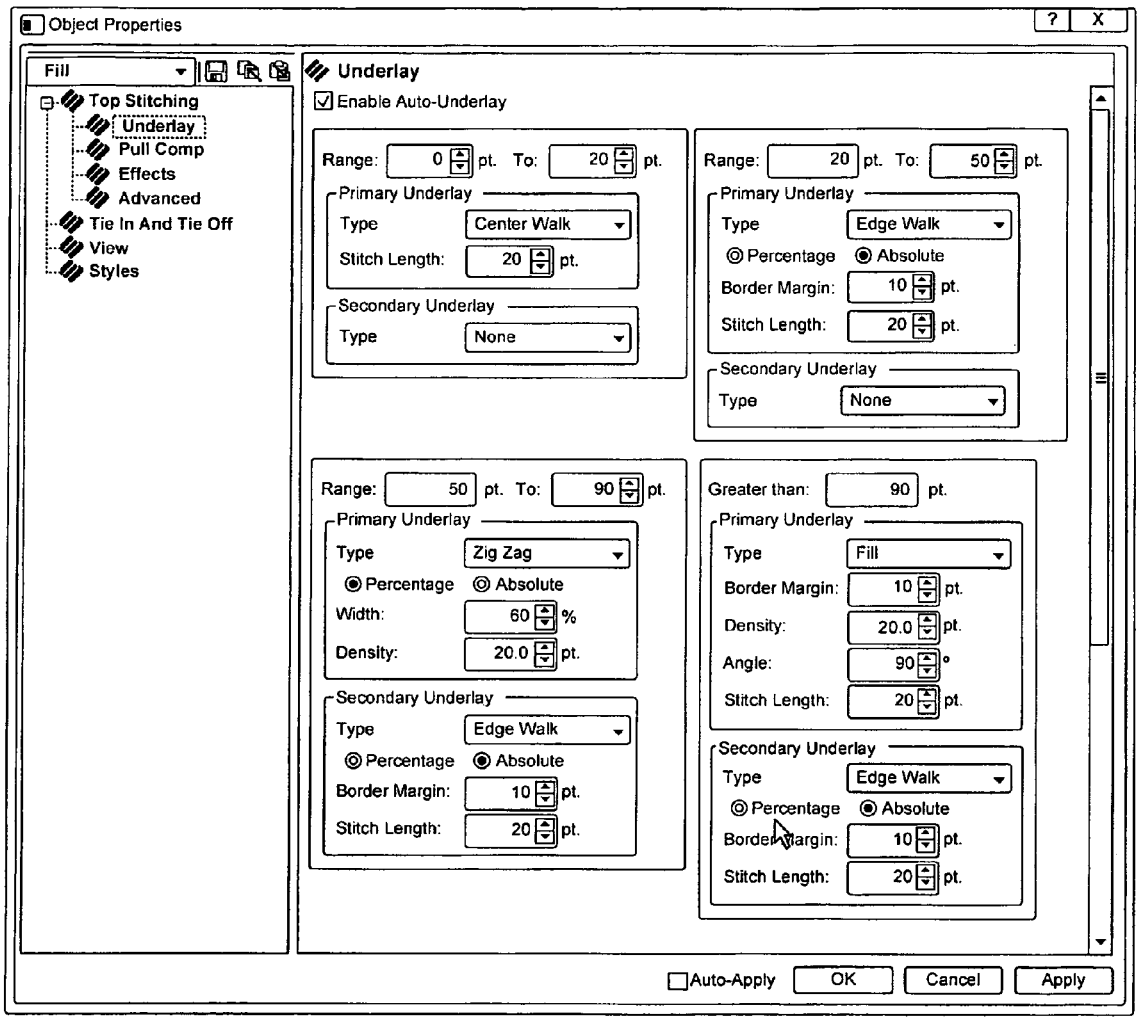
FIG. 4 is a screenshot of the underlay stitch type selection screen of an embroidery design program.
Figure 5:
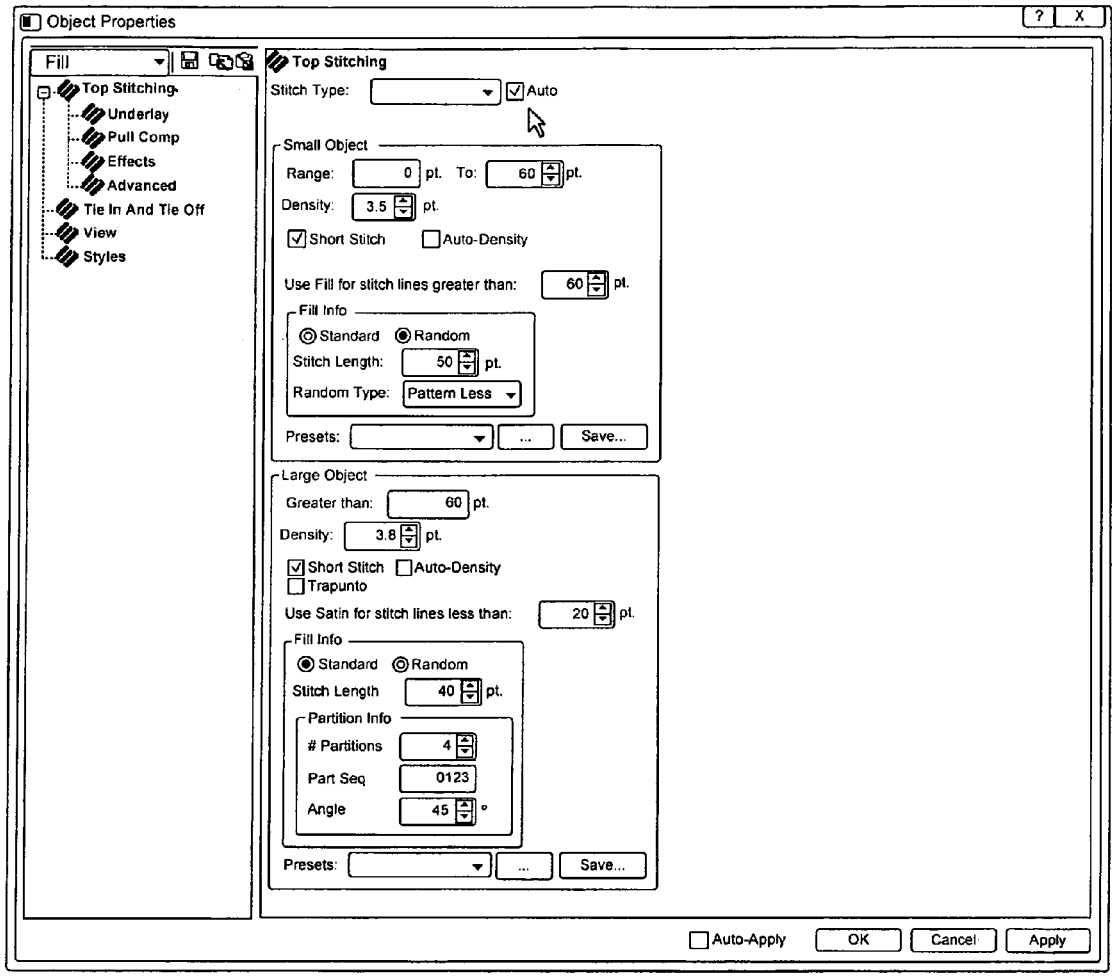
FIG. 5 is a screenshot of the top-stitch selection screen of an embroidery design program.

As shown in FIGS. 3(*a*) and (3)(*b*), the stitch-type-selection chart contains various size ranges and size-range-stitch types corresponding to the size ranges. As shown in FIGS. 3(*a*) and 3(*b*), for different fabric types, the size ranges and size-range-stitch types can vary. Other properties could also be considered and used to affect the size ranges and size-range-stitch types such as, but not limited to stitch density, thread type, thread tension, fabric type, and fabric orientation relative to stitch direction, In another embodiment, size may be only one factor in a multi-factor determination of stitch type. In one embodiment, the stitch-type-selection chart could be preprogrammed and stored by design software. This would allow beginning users to achieve more efficient, better quality embroidery designs. In another embodiment, the size ranges and size-range-stitch types could be selected by a user. Referring to FIGS. 4 and 5 there are screen shots of stitch-selection user interfaces that could be used consistent with the present invention.

Turning first to FIG. 4, shown is an exemplary underlay-stitch-selection user interface that could be used for allowing a user to select size ranges and size-range-stitch types for underlay. For example, for a size range of 0 pt. to 20 pt. (1 point (pt.)=0.1 mm) the primary underlay size-range-stitch type is shown as center walk. For a size range of 50 pt. to 90 pt. the primary underlay size-range-stitch type is shown as zig zag and the secondary underlay size-range-stitch type is shown as edge walk. These fields may be pre-populated based on a preprogrammed chart, such as the chart in FIG. 3, or may be blank. The underlay-stitch-selection user interface in FIG. 4 includes a check-box ("Enable Auto-Underlay") that can be selected if the user wants the system to determine size ranges and the size-range-stitch type for each size range. If the user wants to make his/her own selections, the user can select the size ranges and the primary and secondary underlay size-range-stitch type for each size range.

As shown in FIG. 4, in some embodiments selecting stitch type includes both selecting the proper underlay-stitch type (e.g., edge walk) but also selecting the properties for the underlay-stitch type. For example, if the underlay-stitch type is edge walk, selecting a stitch type can include selecting properties such as border margin and stitch length for the edge walk. For zigzag, properties such as width and density may be selected. Those of skill in the art will be readily aware of the stitch type properties that can be selected for various stitch types.

Similarly, in FIG. 5 there is an exemplary top-stitch-selection user interface that could be used for allowing a user to select size ranges and size-range-stitch types for top-stitch. For example, in FIG. 5 small objects are set as objects (e.g., design elements) with a size of 0 pt. to 60 pt. and large objects are set as objects with a size over 60 pt. In this exemplary embodiment, the top-stitch types are satin and step-fill, where satin is used for small objects and step-fill can be used with large objects. However the size-range-stitch type can be further specified by defining satin and step-fill properties. For example, for satin, properties such as density and stitch length can be preprogrammed or selected by the user. For step-fill, properties such as density, pull compensation, partition line sequence, minimum stitch length, stitch length, and angle, may be preprogrammed or selected by the user.

Figure 6:
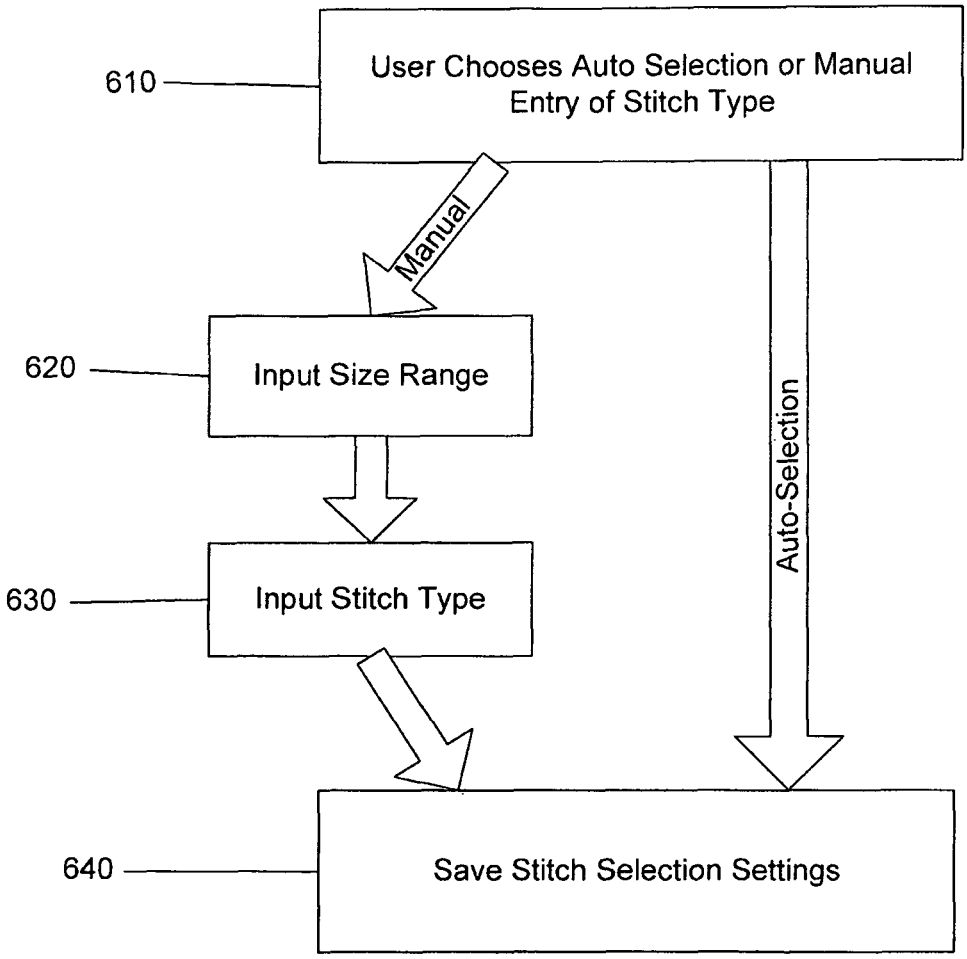
FIG. 6 is a flowchart of the selection of stitch types.

Referring now to FIG. 6, it shows two methods for selecting stitch type. The user can select manual or automatic stitch selection in 610. If the user chooses manual stitch selection, then they must input the stitch types to use and at what ranges to use them in steps 630 and 620 respectively. If they choose automatic, then the invention will use pre-selected stitch types which are well suited for each range and fabric. The system will save the stitch selection settings in step 640. In one embodiment, size ranges and size-range-stitch types are based on either a preprogrammed list or chart or entered by the user before altering the embroidery design. In another embodiment, the user can alter the embroidery design 210 by changing the size ranges and size-range-stitch types after substantially all other alterations are complete. In either case, the size ranges and size-range-stitch types are automatically compared to the size of each design element so that a user does not manually have to select the stitch type for each design element. That is to say the that size ranges and size-range-stitch types are a set of values that can be applied automatically to all design elements, rather than a user having to specify a size-range-stitch type for each design element.

Referring again to FIG. 2, once the stitch type for the embroidery design has been selected 230, the stitch pattern for the embroidery design is generated 240. The stitch pattern for an embroidery design is a set of instructions sufficient to enable an embroidery device to sew the embroidery design. In some embodiments, this can include stitch order, stitch path, and/or stitch coordinates. The stitch pattern can be incorporated into an embroidery file format such as, without limitation, wireframe file (file.ofm), expanded stitch file (file.dst), expanded file (file.exp). Those of skill in the art will be aware of many variations to the stitch pattern consistent with the present invention.

For the present invention, the embroidery design can be altered 210 any number of times. In one embodiment, each time the embroidery design is altered the resulting altered design may undergo the same process. The size of the altered design can be determined 220, the appropriate stitch type selected 230, and the stitch pattern for the altered design is generated 240. In another embodiment, all alterations may be completed before the stitch selection process is completed. In addition to the embodiment disclosed above of selecting top-stitch and underlay stitch type, other parameters and features can be altered.

In yet another embodiment, the stitch selection can be performed on a new embroidery design. In this embodiment, as a user inputs or digitizes a new design element, the size of the new design element can be determined 220, a stitch type selected based on the size of the new design element 230, and a stitch pattern generated for the new design element 240. Variations and modifications of this and other embodiments consistent with the present invention will be readily understood by those skilled in the art.

The invention can also handle the alteration of a design which contains lock stitches such as tie-in and tie-out stitches. This feature allows users to digitize, store, and use their own custom stitch patterns and designate those custom stitch patterns as lock stitches so that they do not change during scaling. In one embodiment, the user can input a user defined stitch pattern for tie-in and/or tie-out stitches and save the user defined stitch pattern as a custom stitch pattern for future use. This allows embroidery production facilities to use different types of tie patterns based on the fabric the design will be sewn on and also the embroidery machine type the design will be produced on. In the present invention, when an embroidery design is scaled, the embroidery design software recognizes the custom-stitch pattern as a lock stitch that should not be scaled. When altering a stitch design the invention can recognize the tie-in and tie-out stitch and not scale or alter the stitch coordinates or stitch pattern representing the tie-in and tie-out stitches. In one embodiment, the design software can hold the size and shape of the custom stitch patterns in memory and places them in the proper parts of the design at only the digitized size, therefore, scaling has no effect on the patterns.

Figure 7:
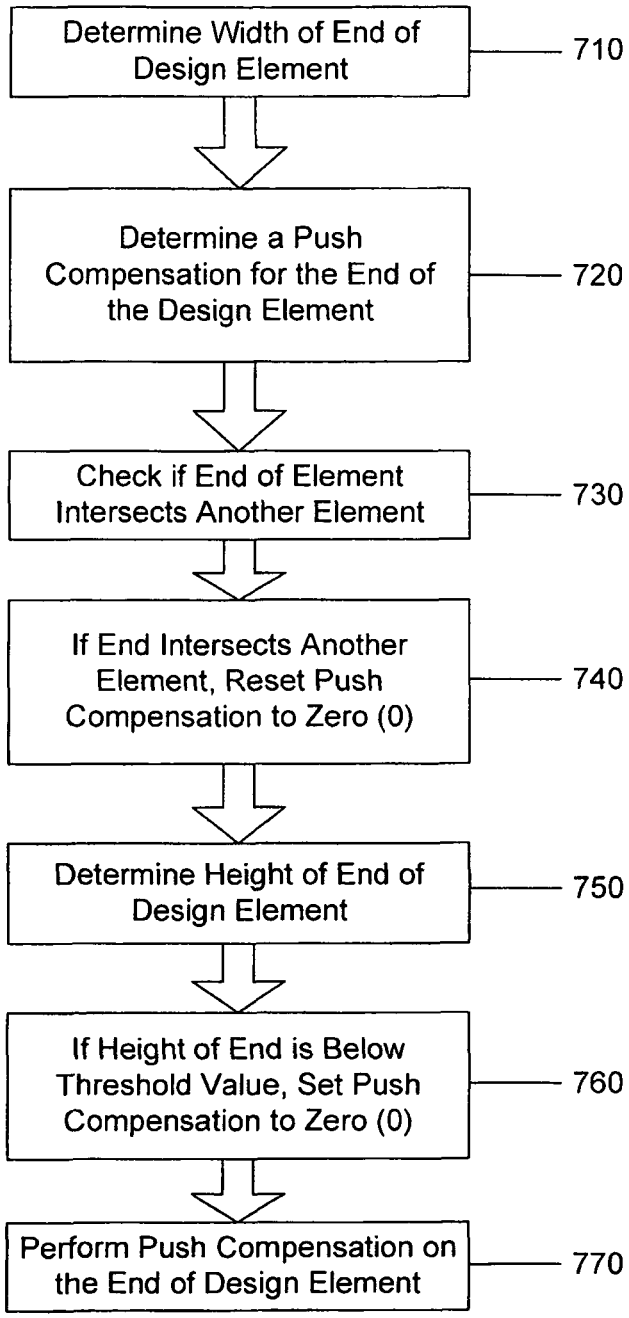
FIG. 7 is a flowchart of a method for push compensation.

In yet another embodiment of the present invention, push compensation of the embroidery design can be performed. Referring to FIG. 7 there is shown an exemplary flowchart for performing push compensation. In this exemplary embodiment, the width of an end of a design element is determined 710. Determining the width of the end of the design element may be performed in many ways. In one embodiment, an average width of the last five (5) stitches for the end is determined. In another embodiment, a median stitch width of the last ten (10) stitches may be used. Those skilled in the art will realize that there are numerous ways of determining the width of the end of the design element.

Using the width of the end of the design element, a push compensation can be determined 720. In one embodiment, based on the experience of embroidering designers and digitizers, a design program could contain a push compensation table which shows the amount to reduce the end of an element based on the width of the element and the current fabric type. In one embodiment, the push compensation program can then check the end of the design element to determine if the end of the design element intersects another design element 730. If it does, no push compensation is needed 740. If push compensation were performed, the elements may fail to intersect.

Similarly, the height of the end of the design element can also be determined 750 so that only design elements of sufficient height are subject to push compensation 760. In one embodiment determining the height of the design element comprises determining the height of the last five (5) stitch lines on the end the design element. A stitch line is a linear line with one or more stitches. This is so that design elements with curves, or design elements under a certain height, not be subject to push compensation. Once the height of the end is determined 750, the height can be compared to a threshold height value to determine if push compensation should be performed 760. In one embodiment, the threshold height can be a predetermined constant value for all widths. In another embodiment, the threshold height can vary based on width of the end of the design element. In yet another embodiment, the threshold height can be a function of the push compensation. For example, the threshold height could equal the push compensation for a given width or some multiplier of the push compensation the a given width.

In step 770, for ends of design elements which require push compensation, the program consults the user defined table and makes the required adjustment 770. In one embodiment, the push compensation can be represented by a number of points by which to reduce the end of the design element. In this embodiment, performing the push compensation 770 could involve determining the number of stitches to remove from the end of the design element in order to reduce the end of the design element by the designated number of points. In another embodiment, performing the push compensation 770 could involve adjusting the stitch coordinates for the end of the design element. For example, instead of removing certain stitches, the stitch coordinates could be moved up or down to avoid the end of the design element from being seen as to long.

One exemplary table for push compensation could be as follows:

| WIDTH RANGE (PTS.) | PUSH COMPENSATION (PTS.) |
|---|---|
| 0-20 | −4 |
| 20-35 | −5 |
| 35-50 | −6 |
| 50+ | −7 |

The table above is exemplary only. Those of skill in the art will realize that the push compensation values and width ranges could vary based on other properties such as, but not limited to, stitch density, thread type, thread tension, fabric type, backing and fabric orientation relative to stitch direction, It will be recognized by those of skill in the art that order of many steps 710-770 can be varied consistent with the present invention. For example, in one embodiment, it can be first determined whether an end of a design element intersects another design element 730. If there is an intersection, the entire push compensation process can be aborted. Further variations and changes can also be made within the scope of the present invention.

Figure 8:
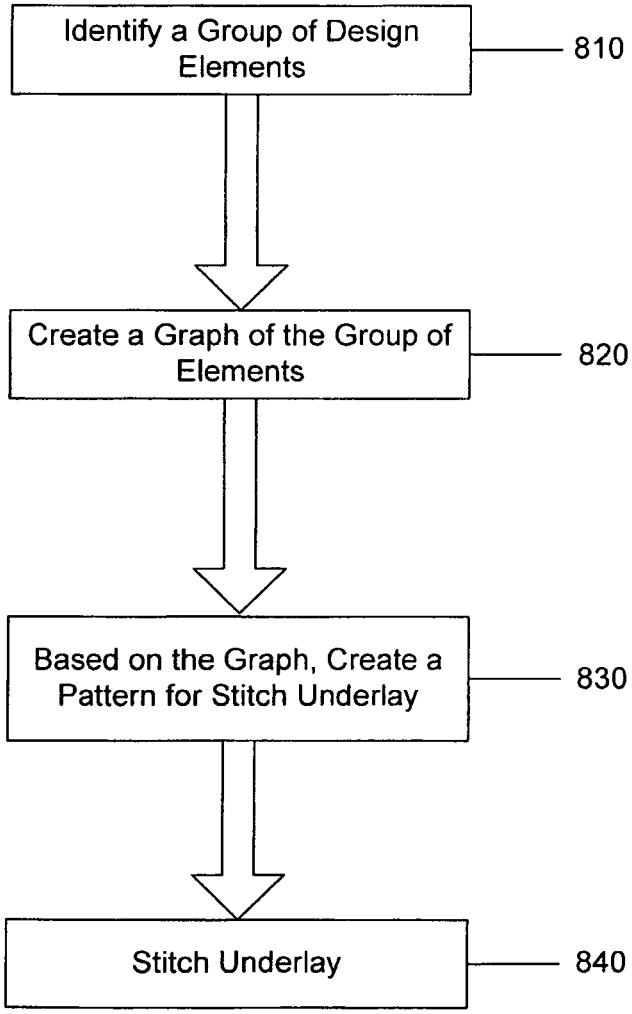
FIG. 8 is a flowchart of a method of stitching continuous underlay.

The invention also provides a method for implementing continuous underlay for a group of design elements. FIG. 8 show a possible embodiment of the invention. In step 810, the invention identifies a group of design elements. There a number of ways that this can be accomplished. For example, in one embodiment a group of design elements can be identified 810 by determining intersecting, or sufficiently proximate, design elements. For intersecting, or overlapping elements, a group of design elements can be identified 810 based on each design element overlapping with at least one other design element in the group. In another embodiment, a group of design elements may be a set of design elements which are sufficiently close to be treated as a group for continuous stitching. For this embodiment, a group of design elements can be identified 810 based on each design element being sufficiently close to at least one other design element in the group. Determining proximity of design elements can be based on temporary stitch coordinates for the design element, or based on positioning of the vector or raster shape of the design elements. Other examples and methods for determining a group of design elements will be understood by those skilled in the art.

In step 820 the program creates a graph of the group of design elements. In this embodiment, the graph could be a set of vertices and edges that represent the group of design elements. Using that graph, in step 830, the program creates a pattern for stitching the continuous underlay for the group of elements. After the pattern is created, the design can be transferred to an embroidery machine and the underlay can be stitched as part of the larger pattern.

Figure 9:
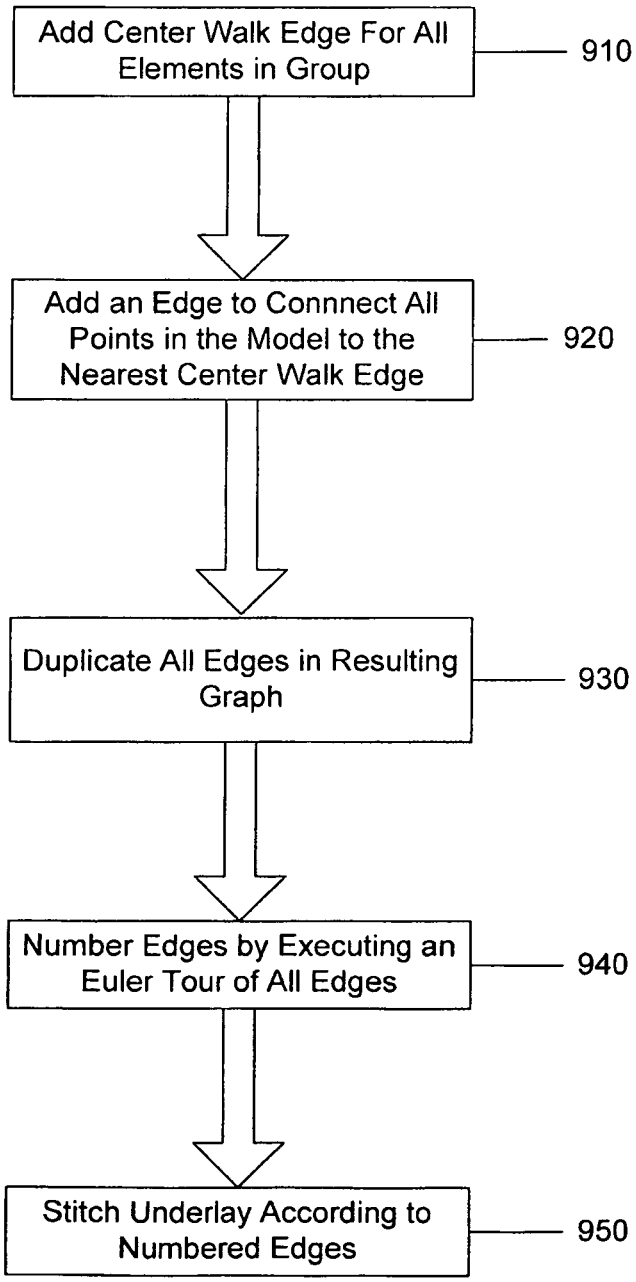
FIG. 9 is a flowchart of a method for creating an ordered model for stitching continuous underlay.
Figure 10A:
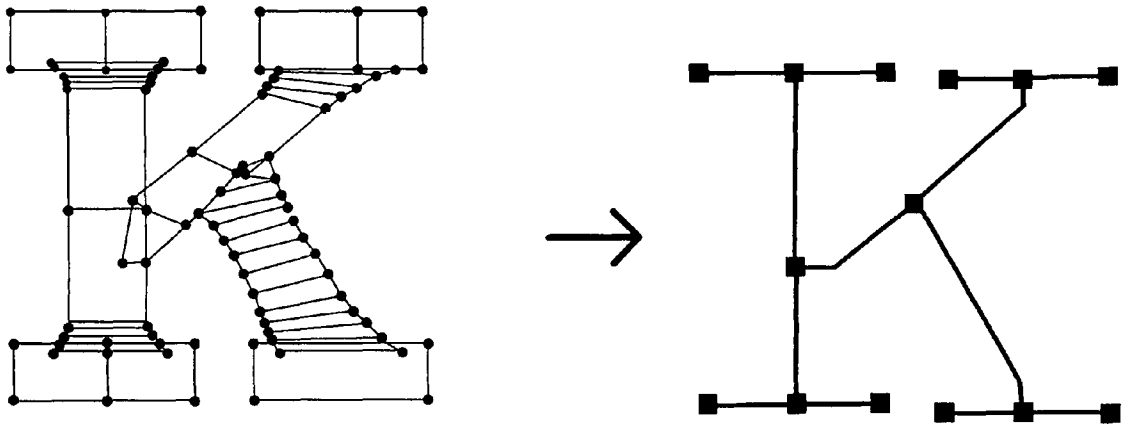
FIG. 10*a-g* is a diagram for creating an ordered model for stitching continuous underlay.
Figure 10B:
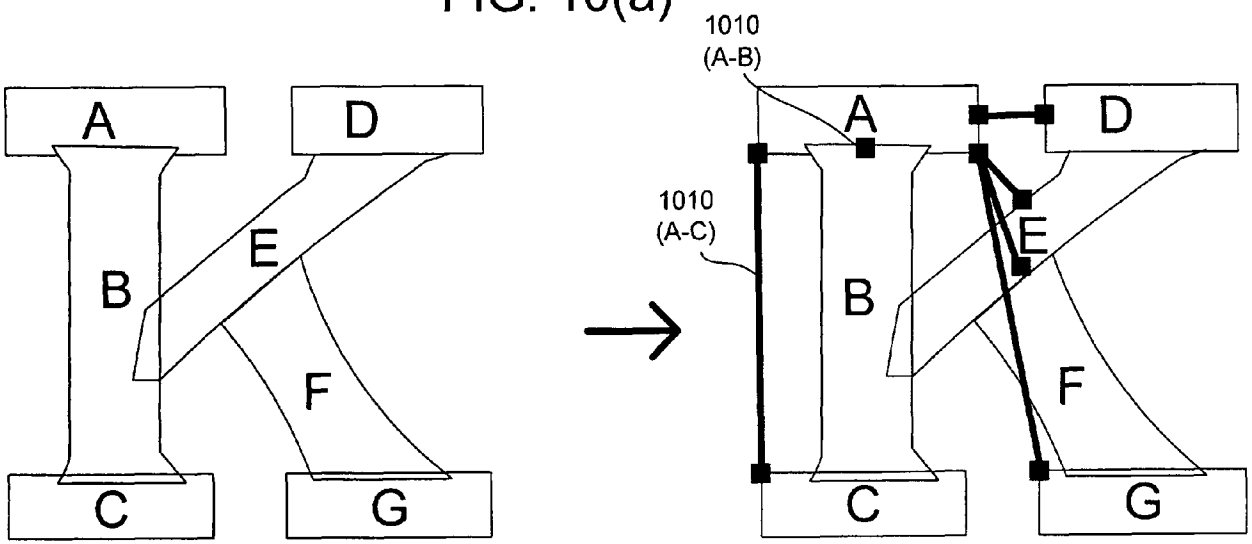
Figure 10C:
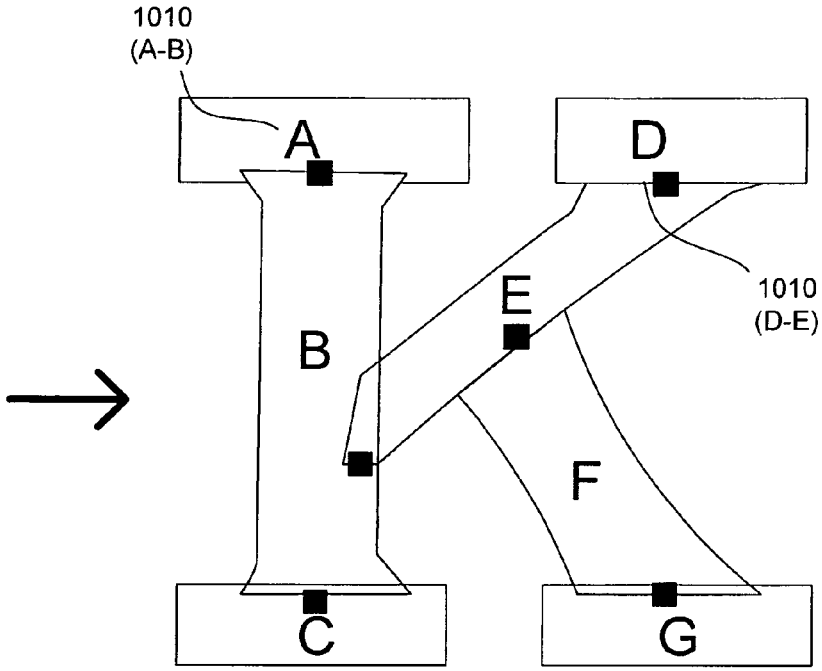
Figure 10D:
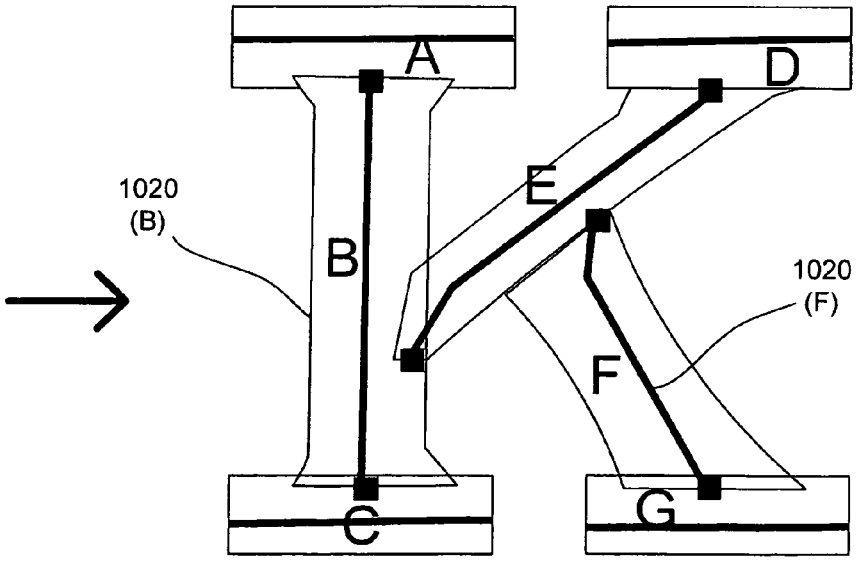
Figure 10E:
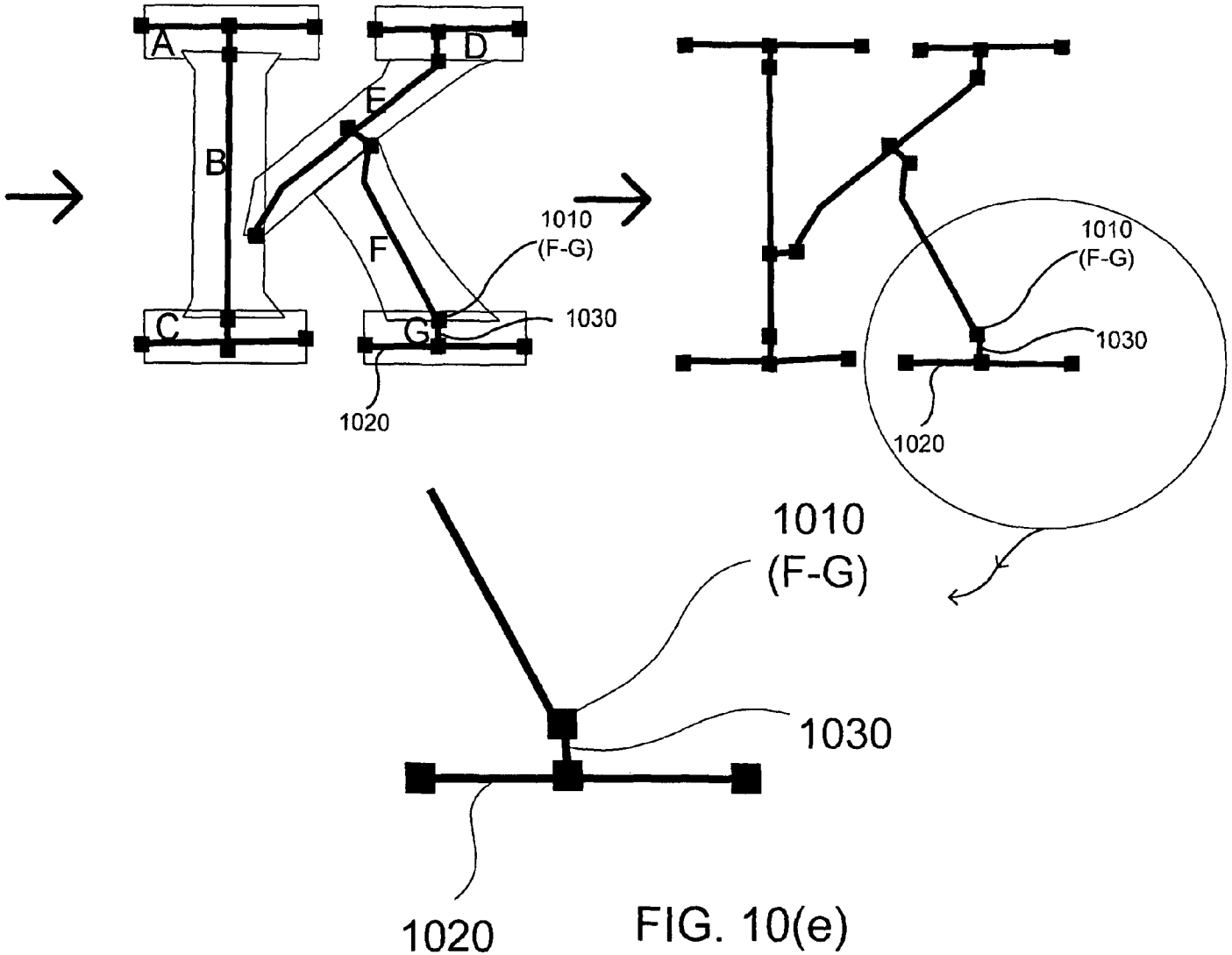
Figure 10F:
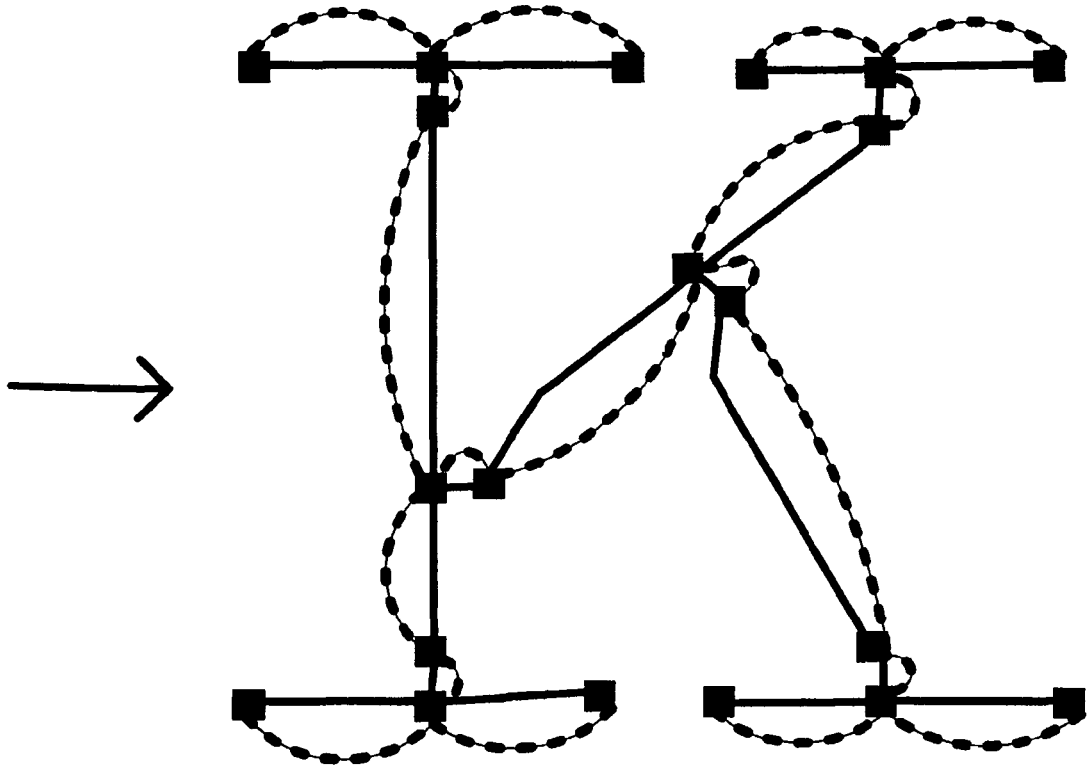
Figure 10G:
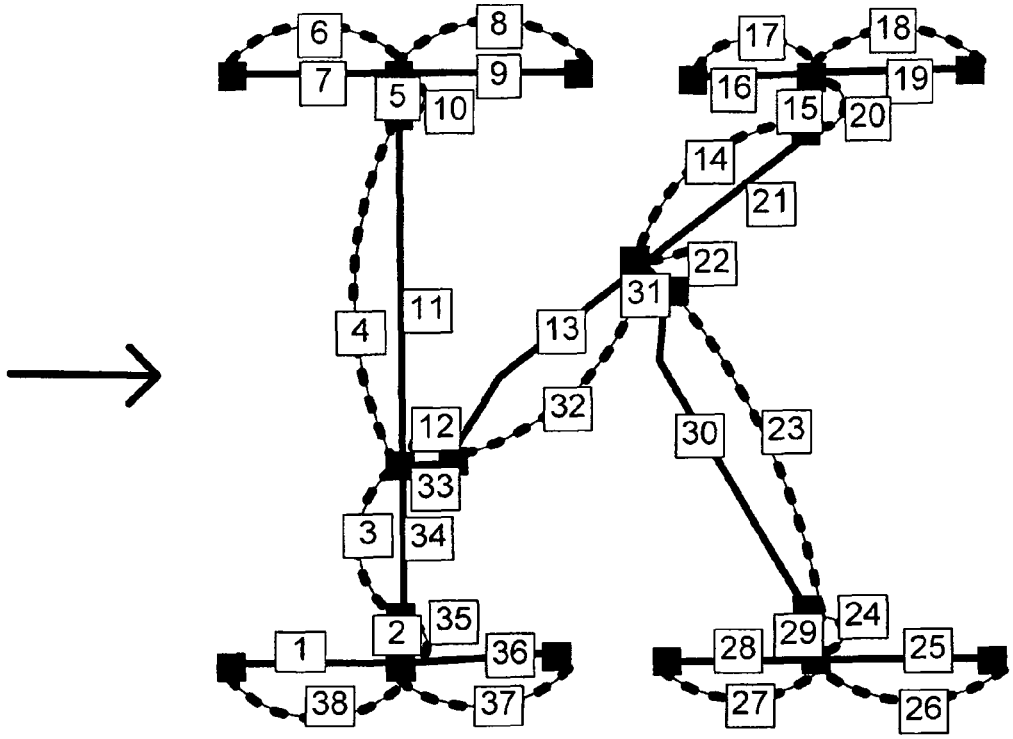

Referring now to FIGS. 9 and 10, there is shown a method for creating a graph model of a group of design elements for continuous underlay. In FIG. 10 a group of design elements A-G representing the letter "K" are shown. In order to determine design elements A-G are part of a design group, a connector 1010 (examples are labeled for element A to B and element A to C) between Element A and all other design elements is identified. In the preferred embodiment, the connector between design elements represents the shortest distance between the design elements. This process is then repeated for elements B-E (not shown). Once all connectors are created, any connectors longer than a predetermined threshold length are deleted. For example, in FIG. 10(*c*), the only remaining connector 1010 (A-B) for element A is the connector between element A and element B. This ensures that elements which are too far apart are not included in the design element group. After the connectors above the threshold are deleted, the remaining connectors can then be used to create the graph.

After the group is selected, the graph of the group of design elements can be created as outlined in step 820. FIG. 9 shows a flowchart of a method for creating a graph of the group of design elements. In step 910, a center walk 1020 is added for all elements in the group as shown in FIG. 10(*d*) (examples are labeled for element A and element F). In step 920, the connectors in the model, are connected to the center walk using an edge line or link-line 1030. This is shown in FIG. 10(*e*) (the example labeled is for the link-line 1030 between the center walk 1020 for element G the connector 1010 between elements F and G). Once the link-line is added, a line graph of the model has been created. In this embodiment, however, each edge (e.g., center walk edge and link line) must be duplicated 930 as shown in FIG. 10(*f*). The purpose of duplicating each edge is to ensure that each node of the resulting duplicate-line graph has an even degree (or an even number of lines or edges connected to it) for a Euler Tour. With the duplicate-line graph model created, a Euler Tour can performed on all the edges. An Euler Tour as mentioned in step 940 is a method for numbering all the edges or lines in a particular order. The numbered edges are shown in FIG. 10(*g*). When the edges are numbered the resulting graph serves as a continuous ordered pattern for the underlay. The underlay can be sewn according to that pattern 950.

Other methods of modeling the group of design elements in order to create a continuous underlay pattern will be readily understood by those skilled in the art. For example, a depth first search (DFS) algorithm could be used consistent with the present invention in order to traverse each line or edge in the graph of the group of design elements. Other graph search algorithms or graph traversal algorithms, such as but not limited to, breadth first search, depth limited search, Dijkstra's algorithm, the Floyd-Warshall algorithm, etc., could also be used consistent with the present invention as will be readily understood by those skilled in the art.

Figure 11:
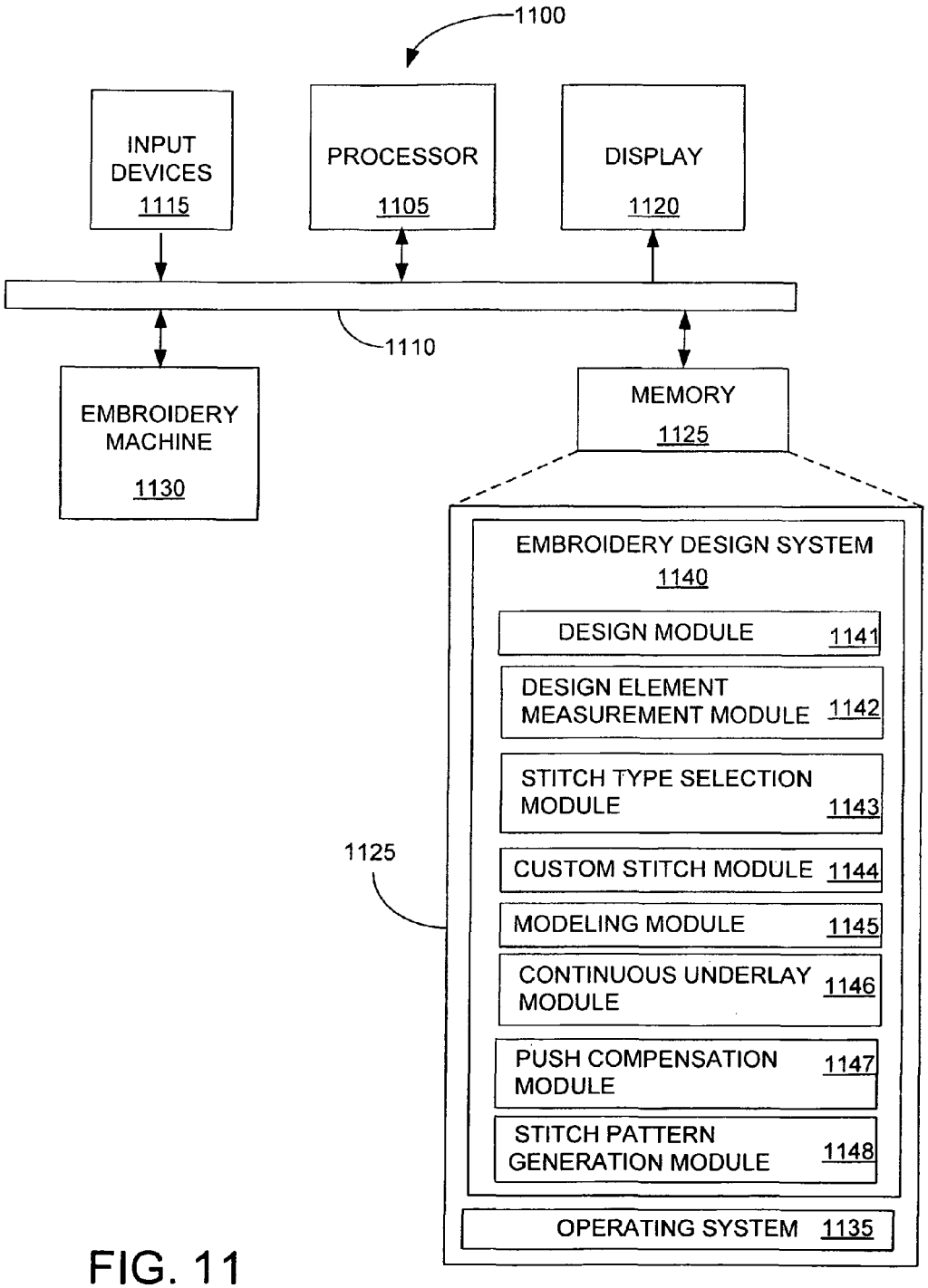
FIG. 11 is a diagram of a computer with an embroidery design system in accordance with the present invention.

Turning now to FIG. 11, it is a functional block diagram of a digital computer ("computer") 1100 equipped with an embroidery design system 1140 in accordance with an illustrative embodiment of the invention. Computer 1100 may be a desktop computer, workstation, laptop computer, notebook computer, handheld computer, or any other device that includes computing functionality. In FIG. 11, processor 1105 communicates over data bus 1110 with input devices 1115, display 1120, memory 1125, and embroidery machine 1130. In some embodiments, the embroidery machine 1130 may be located separately and not connected to the data bus 1110. In other embodiments, the embroidery machine 1130 can be located over a network connection (not shown) to the computer 1100. In yet another embodiment, the embroidery machine 1130 can receive information from the computer 1100, and embroidery design system 1140, via a portable storage device (not shown) such as a hard disk drive, a floppy disk, an optical disc, and/or a flash-memory-based storage device Input devices 1115 may be, for example, a keyboard and a mouse or other pointing device. Memory 1125 may include random-access memory (RAM), read-only memory (ROM), flash memory, or a combination thereof.

Memory 1125 includes embroidery design system 1140 and operating system 1135. In one embodiment, operating system 1135 is a version of MICROSOFT WINDOWS (e.g., WINDOWS 98, WINDOWS NT, WINDOWS 2000, WINDOWS CE, WINDOWS ME, WINDOWS XP, WINDOWS VISTA, etc.). In other embodiments, the principles of the invention may be applied to other operating systems.

For convenience here, the functionality of embroidery design system 1140 has been divided into eight functional modules: design module 1141, design element measurement module 1142, stitch type selection module 1143, custom stitch module 1144, modeling module 1145, continuous underlay module 1146, push compensation module 1147 and stitch pattern generation module 1148. In various embodiments of the invention, the functionality of these modules may be combined or subdivided in a variety of ways different from that indicated in FIG. 11. Also, these functional modules may be implemented in software, firmware, hardware, or any combination thereof. In some embodiments, the above functional modules are embodied as program instructions executable by processor 1105 and stored on a computer-readable storage medium, the various functions performed by the modules being assigned to a plurality of instruction segments. The computer-readable storage medium can include, without limitation, a hard disk drive, a floppy disk, an optical disc, a flash-memory-based storage device, or other computer-readable medium.

Referring first to the design module 1141, this module contains each element of the embroidery design and their properties. The design module can take an embroidery design as an input, such as from a design file, or an embroidery design can be created in the design module with user input. Alterations to the embroidery design by other modules are saved to the embroidery design in the design module 1141. The embroidery design can be stored in a number of formats and can be output to be stitched by an embroidery machine.

The second module 1142, the design element measurement module, can use many possible methods to determine the size of a design. The module can analyze the stitch width of an element to determine its size. It can also determine size based on vector shape(s) or raster shape(s). Once the design element measurement module determines the size it makes the size available for use by other modules.

The third module 1143 is the stitch type selection module. This module interacts with module 1142 and uses the size determined by that module to select a stitch type. Module 1143 bases its selection on a stitch-type-selection chart which contains a set of values which guide in selecting stitch type. The stitch-type-selection chart can either be preprogrammed or based on user input. The stitch type selection module operates separately on each design element in order to make a more appropriate stitch type selection.

The custom stitch module 1144 takes input from the user and saves information to the design module 1141. It allows the user to input a custom lock stitch which can be saved and used again on other designs. Custom lock stitches are recognized by the system and their size remains constant, even if the size of the design changes.

The modeling module 1145 can take as input a group of design elements and create an ordered model or graph of those elements. The procedure carried out by the modeling module 1145 is outlined in FIGS. 9 and 10. The output of the modeling module 1145 is a model or graph which can be used by other modules.

The model created by the modeling module 1145 can be used by the continuous underlay module 1146 in order to determine a stitch patter for sewing the continuous underlay. The continuous underlay module 1146 adds to the embroidery design a series of stitches which provide an improved base for the top stitches.

The push compensation module 1147 performs push compensation. The push compensation module can communicate with the design measurement module 1142, which can measure the width of the end of each design element, to obtain information for push compensation. The design measurement module 1142 can perform this measurement in a number of ways. The module 1147 can determine which elements require push compensation and which do not. Using the measurement, the module 1147 can also determine how to perform push compensation on the element and then perform that compensation. The module 1147 performs the push compensation by adjusting the end of the element in the design to the element will appear more visually pleasing.

The stitch pattern generation module 1148 converts the design contained in the design module 1141. The design in 1141 contains all the changes which are made to the design 1141 by the other modules. The module 1148 may change the design from the format in which it is stored into a stitch pattern file which can be sewn by an embroidery machine.

In conclusion, the present invention provides, among other things, a method and apparatus for altering sewing designs while automatically altering or maintaining certain parameters or features. It also provides a method for design and underlay for a group of design elements which results in a more stable design. Those skilled in the art can readily recognize that numerous variations and substitutions may be made in the invention, its use, and its configuration to achieve substantially the same results as achieved by the embodiments described herein. Accordingly, there is no intention to limit the invention to the disclosed exemplary forms. Many variations, modifications, and alternative constructions fall within the scope and spirit of the disclosed invention as expressed in the claims.

What is claimed is:

1. A method for creating an altered embroidery design, the method comprising:

altering an embroidery design to create the altered embroidery design, the altered embroidery design comprising an at least one design element, the at least one design element representing a discrete portion of the altered embroidery design;

determining a size of the at least one design element by assigning a temporary stitch type to the at least one design element, generating temporary stitches for the at least one design element, and determining the size of the at least one design element based on a stitch-width of the temporary stitches;

selecting a stitch type for the at least one design element by comparing the size of the at least one design element to a set of values, wherein the stitch type is selected from the set of values based on the size of the at least one design element; and generating a stitch pattern for the at least one design element.

2. The method of claim 1, wherein altering the embroidery design comprises scaling the embroidery design up in size.

3. The method of claim 1, wherein altering the embroidery design comprises changing a fabric for the embroidery design.

4. The method of claim 1, wherein selecting the stitch type comprises selecting an underlay-stitch type.

5. The method of claim 4, wherein selecting the underlay-stitch type comprises selecting the underlay-stitch type from the group consisting of center walk, edge walk, zigzag and fill.

6. The method of claim 1, wherein selecting the stitch type comprises selecting a top-stitch type.

7. The method of claim 6, wherein selecting the top-stitch type comprises selecting the topstitch type from the group consisting of satin and step-fill.

8. The method of claim 1, wherein determining the size of the at least one design element based on the stitch-width of the temporary stitches comprises:

selecting a stitch-width of a representative temporary stitch as representing the size of the at least one design element.

9. The method of claim 8, wherein selecting the stitch width of the representative temporary stitch comprises:

selecting the stitch width of the representative temporary stitch, wherein the representative temporary stitch has the median of the temporary stitches for the at least one design element.

10. The method of claim 1, wherein selecting the stitch type for the at least one design element comprises:

selecting the stitch type by comparing the size of the at least one design element to a list of at least two size ranges, wherein each of the at least two size ranges corresponds to a size-range-stitch type.

11. The method of claim 10, wherein the size-range-stitch type and list of at least two size ranges are determined by a user.

12. The method of claim 10, where the size-range-stitch type and list of at least two size ranges are preprogrammed.

13. The method of claim 1, further comprising:

selecting a secondary stitch type for the at least one design element based on the size of the at least one design element.

14. The method of claim 13, wherein selecting a secondary stitch type comprises selecting a secondary underlay-stitch type.

15. The method of claim 1, wherein selecting the stitch type for the at least one design element by comparing the size of the at least one design element to the set of values comprises:

selecting the stitch type for the at least one design element by comparing the size of the at least one design element to a predetermined set of values.

16. The method of claim 1, wherein generating the stitch pattern for the at least one design element comprises generating stitch coordinates usable by an embroidery device to sew the at least one design element.

17. The method of claim 1, wherein altering the embroidery design to create the altered embroidery design comprises changing a size range or a size-range-stitch type of the set of values.

18. The method of claim 1, further comprising:

sewing the stitch pattern for the at least one design element.

19. A method for selecting stitch types for an embroidery design, the method comprising:

creating the embroidery design, the embroidery design comprising at least a first design element and a second design element, the first design element and the second design element each representing a discrete portion of the altered embroidery design;

determining a size of the first design element by assigning a temporary stitch type to the at least one design element, generating temporary stitches for the at least one design element, and determining the size of the at least one design element based on a stitch-width of the temporary stitches;

selecting a first stitch type for the first design element by comparing the size of the first design element to a set of values, wherein the first stitch type can be selected from the set of values based on the size of the first design element;

determining a size of the second design element;

selecting a second stitch type for the second design element by comparing the size of the second design element to the set of values, wherein the second stitch type can be selected from the set of values based on the size of the second design element; and generating a stitch pattern for the embroidery design using the first stitch type for the first design element and the second stitch type for the second design element.

20. The method of claim 19, wherein:

selecting the first stitch type for the first design element comprises selecting a first-underlay-stitch type for the first design element; and selecting the second stitch type for the second design element comprises selecting a second-underlay-stitch type for the second design element.

21. The method of claim 19, wherein:

selecting the first stitch type for the first design element comprises selecting a first-top-stitch type for the first design element; and selecting the second stitch type for the second design element comprises selecting a second-top-stitch type for the second design element.

22. The method of claim 19, wherein the first stitch type and the second stitch type are different.

23. The method of claim 19, wherein:

determining the size of the second design element comprises:

assigning the temporary stitch type to the second design element;

generating temporary stitches for the second design element; and determining the size of the second design element based on a stitch-width of the temporary stitches for the second design element.

24. The method of claim 19, wherein:

selecting the first stitch type for the at least one design element comprises:

selecting the first stitch type by comparing the size of the first design element to a list of at least two size ranges, wherein each of the at least two size ranges corresponds to a size-range-stitch type; and selecting the second stitch type for the second design element comprises:

selecting the second stitch type by comparing the size of the second design element to the list of at least two size ranges.

25. The method of claim 19, further comprising:

sewing the stitch pattern for the embroidery design.

* * * * *